US012031408B2

(12) United States Patent
Leon et al.

(10) Patent No.: US 12,031,408 B2
(45) Date of Patent: Jul. 9, 2024

(54) RUPTURE DISK, METHOD AND SYSTEM

(71) Applicants: Claudia Leon, Houston, TX (US); Frank Maenza, Houston, TX (US); Tyler Shirk, Houston, TX (US)

(72) Inventors: Claudia Leon, Houston, TX (US); Frank Maenza, Houston, TX (US); Tyler Shirk, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/330,727

(22) Filed: May 26, 2021

(65) Prior Publication Data

US 2022/0381113 A1 Dec. 1, 2022

(51) Int. Cl.
*E21B 34/06* (2006.01)

(52) U.S. Cl.
CPC ..... *E21B 34/063* (2013.01)

(58) Field of Classification Search
CPC ..... E21B 34/063; E21B 33/1208; Y10T 137/1729; Y10T 137/1744
See application file for complete search history.

(56) References Cited

U.S. PATENT DOCUMENTS 3,445,032 A * 5/1969 Hansen ..... F16K 17/162 220/89.2
6,178,983 B1 1/2001 Cullianane et al.
6,378,544 B1 * 4/2002 DiBello ..... F16K 17/16 137/68.27
6,446,653 B2 9/2002 Cullinane et al.
9,551,429 B2 1/2017 Walker et al.
9,593,542 B2 3/2017 Getzlaf et al.
10,184,308 B2 1/2019 Chauffe et al.
10,228,068 B2 3/2019 Goggin et al.
10,316,979 B2 * 6/2019 Petrowsky ..... F16K 17/162
2009/0302035 A1 12/2009 Shaw et al.
2011/0000676 A1 * 1/2011 Brandsdal ..... E21B 33/12 166/317
2011/0284243 A1 * 11/2011 Frazier ..... E21B 34/063 166/376
2014/0008085 A1 * 1/2014 Tinnen ..... E21B 33/134 166/134
2017/0204703 A1 7/2017 Mair
(Continued)

FOREIGN PATENT DOCUMENTS

CN 211715095 U 10/2022
WO 2016037281 A1 3/2016

OTHER PUBLICATIONS

"Port" definition available from: https://www.thefreedictionary.com/port, accessed Feb. 21, 2023 (Year: 2023).*
(Continued)

*Primary Examiner* — Theodore N Yao
(74) *Attorney, Agent, or Firm* — CANTOR COLBURN LLP

(57) ABSTRACT

A rupture disk. The disk includes a body having an inside surface defining a hollow therein and a fluid port disposed to make fluid connection between the hollow and a fluid pressure source. A method for operating a wellbore includes applying pressure though the port of a disk, and rupturing the disk with the applied pressure.

14 Claims, 2 Drawing Sheets

(56) References Cited

U.S. PATENT DOCUMENTS

| | | | |
|---|---|---|---|
| 2017/0370182 | A1 | 12/2017 | Provost |
| 2018/0283121 | A1 | 10/2018 | Zhang et al. |
| 2019/0360301 | A1 | 11/2019 | Getzslaf et al. |
| 2020/0009666 | A1 | 1/2020 | Krebill et al. |
| 2021/0071492 | A1 | 3/2021 | Fripp et al. |

OTHER PUBLICATIONS

Notification of Transmittal of the International Search Report and the Written Opinion of the International Searching Authority, or the Declaration; PCT/US2022/072501; Mail Date: Sep. 19, 2022: 10 pages.

* cited by examiner

RUPTURE DISK, METHOD AND SYSTEM

BACKGROUND

In the resource recovery and carbon dioxide sequestration industries, rupture disks are often used for various utilities. Generally, such disks work well for their intended purposes, but they do tend to suffer from fragmentation in ways that leave too large fragments that can interfere with other wellbore operations. This is clearly undesirable, and the art would well receive alternate constructions that avoid the unfortunate fragmentation.

SUMMARY

An embodiment of a rupture disk including a body having an inside surface defining a hollow therein, a fluid port disposed to make fluid connection between the hollow and a fluid pressure source.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
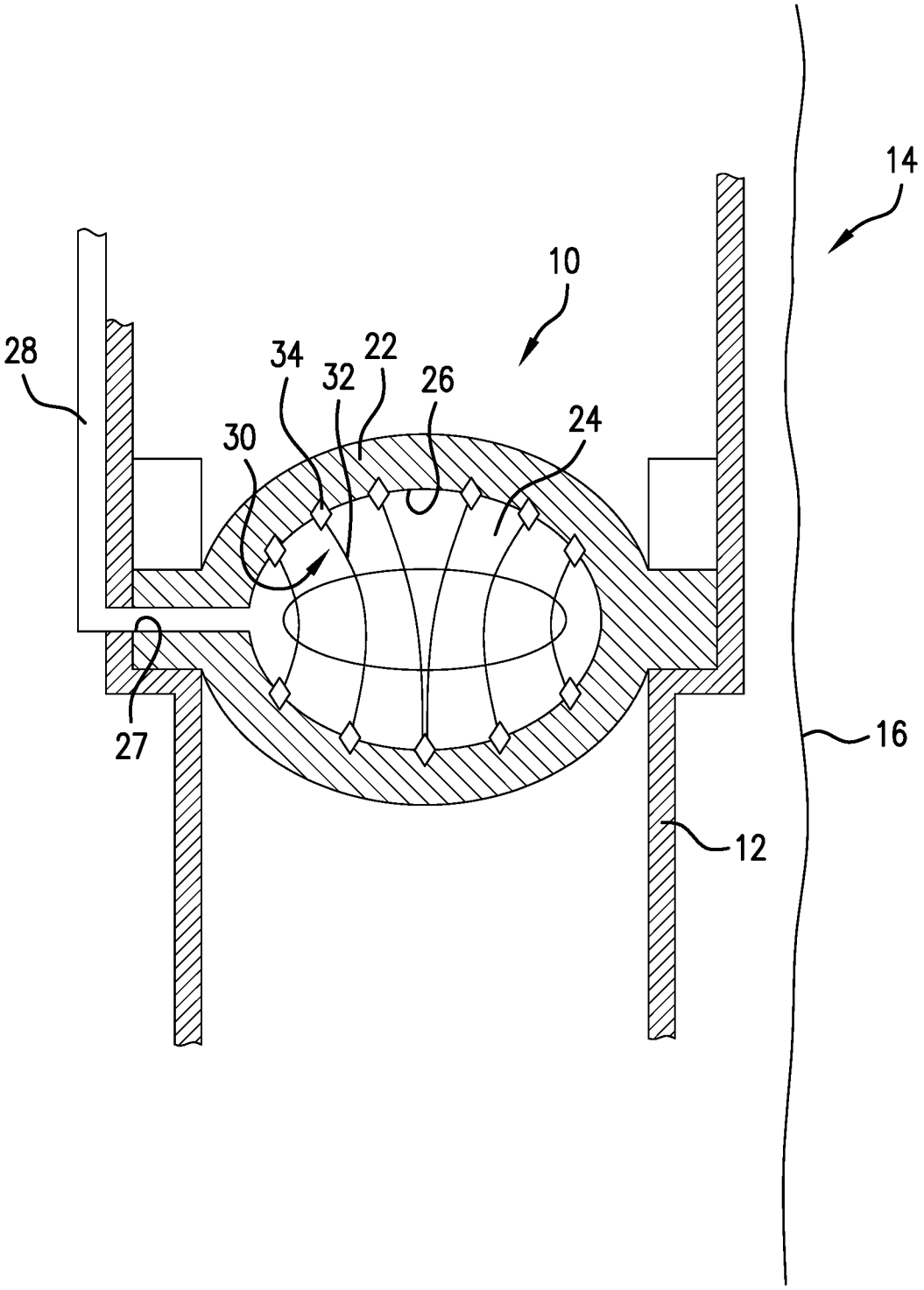
FIG. 1 is a schematic section view of a rupture disk as disclosed herein.

Referring to FIG. 1, a rupture disk 10 is illustrated. The disk 10 is disposed in a tubular member 12 that may be a part of or disposed within a string 14 in a borehole 16 of a wellbore system 20 (see FIG. 2). Disk 10 comprises a body 22 that defines a hollow interior 24 at inside surface 26 of the body 22. The hollow 24 is fluidically connected through a port 27 with a control line 28 that extends to a source of pressurized fluid (not shown). The source may be at surface or at a more local location relative to the disk 10, in for example a downhole pump or a pressure vessel with remotely openable valve. Pressure applied within the hollow 24 of the disk 10 tends to cause the disk 10 to rupture. While many different materials could be used to construct the disk, with varying pressure thresholds for rupturing the same, in an embodiment contemplated herein, the disk comprises a rigid material such as a ceramic material that may be cast or additively printed. Such materials are not very elastic in nature and therefore do not well absorb applied pressure through control line 28. Rather, the disk 10 that comprises a rigid material tends to fracture with the application of fluid pressure at a lower threshold pressure. Depending upon application, materials may be selected to secure an appropriate threshold pressure for rupture.

At this stage of the discussion it is important to note that although the drawings show additional features, which will be described further hereunder, disk 10 may be employed just as described so far with the inside surface 26 having no special features. The disk 10 will still fracture with applied pressure through control line 28 at a predictable threshold pressure based upon material selection for the disk 10.

Alternatively, the inside surface 26 of disk 10 may also be provided with one or more stress risers 30 therein. A stress riser is any feature that tends to concentrate stress within the body 22 to cause an earlier failure of the material of the body 22. The stress risers 30 are not exposed to an environment external to the disk 10. Specifically, an outside surface 32 of disk 10 (whether the material of the disk itself or a coating on that material) is unbroken by stress risers 30. The addition of stress risers to the disk 10 has two effects on the disk 10. The first is that the applied pressure required to fracture the disk will be reduced since the stress riser 30 will tend to initiate a fracture at a lower applied pressure; and the second is that geometry of resulting fragments of the disk 10 may be directed using stress risers 30. Stress risers 30 may include one or more of discrete indentations, grooves and nodes. In one embodiment, illustrated in FIG. 1, there is a pattern of stress risers 30 in the form of unconnected indentations along the surface 26. The pattern may be a dot matrix. Each of these will tend to initiate a fracture and hence contribute to the greater fragmentation of the disk 10, when ruptured. Stress risers 30 may also be parts of a pattern of stress risers 30 connected together such as by forming a pattern using grooves 32 in the inside surface 26. In yet another embodiment, the stress risers 30 may also include nodes 34 in the grooves 32 that may more deeply enter the body 22 through surface 26 than do the grooves. Nodes 34, in an embodiment would be at intersections of the grooves 32. In each embodiment, the goal is fragmentation of the disk 10 at a selected threshold of pressure with fragmentation that follows the stress risers 30 in order that pieces left after rupture of the disk 10 do not interfere with other wellbore operations and can be circulated out of the well or allowed to drop into a rat hole or equivalent.

In one convenient means for manufacturing the disk 10 with or without stress risers 30, an additive manufacture process may be employed.

In use, the disk 10 is placed in a string 14 and is a barrier to fluid flow therepast. When it is desired to open the fluid path, pressure is applied to the disk 10 through the line 28 to exceed a selected threshold pressure designed into the disk 10 during manufacture thereof. Upon reaching the threshold pressure, the disk 10 ruptures and fractures along a prescribed geometry due to the positioning of the stress risers 30.

Figure 2:
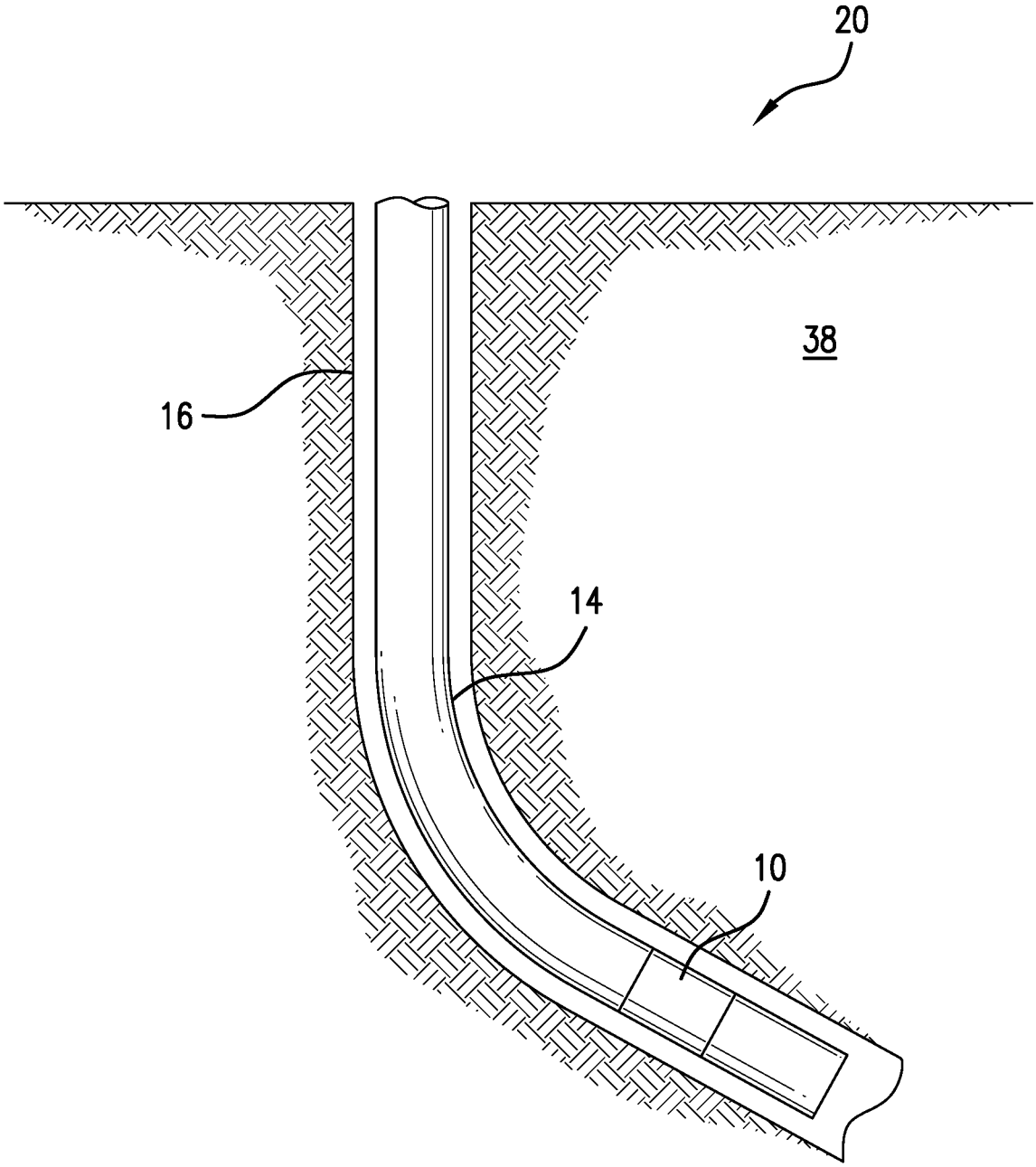
FIG. 2 is a schematic view of a wellbore system having the rupture disk of FIG. 1 disposed therein.

Also disclosed referring to FIG. 2, is a wellbore system 20 (first introduced above). The system 20 includes a borehole 16 in a subsurface formation 38. The string 14 is disposed in the borehole 16. The string 14 supports within or supports as a part of itself, the disk 10.

Set forth below are some embodiments of the foregoing disclosure:

Embodiment 1: A rupture disk including a body having an inside surface defining a hollow therein, a fluid port disposed to make fluid connection between the hollow and a fluid pressure source.

Embodiment 2: The disk as in any prior embodiment, wherein the body comprises a rigid material.

Embodiment 3: The disk as in any prior embodiment, wherein the body is a ceramic material.

Embodiment 4: The disk as in any prior embodiment, wherein the inside surface includes a stress riser.

Embodiment 5: The disk as in any prior embodiment, wherein the stress riser extends through the inside surface and leaves unbroken an outside surface of the body.

Embodiment 6: The disk as in any prior embodiment, wherein the stress riser is a pattern of stress risers.

Embodiment 7: The disk as in any prior embodiment, wherein the pattern is a dot matrix.

Embodiment 8: The disk as in any prior embodiment, wherein the pattern includes grooves connecting nodes.

Embodiment 9: A method for operating a wellbore including applying pressure though the port of a disk as in any prior embodiment, and rupturing the disk with the applied pressure.

Embodiment 10: The method as in any prior embodiment, wherein the applying is from a surface source of pressure.

Embodiment 11: The method as in any prior embodiment, wherein the applying is from a downhole source of pressure.

Embodiment 12: The method as in any prior embodiment, wherein the rupturing includes initiating fractures at stress risers in the body.

Embodiment 13: The method as in any prior embodiment, wherein the stress risers are in fluid communication with the hollow.

Embodiment 14: A wellbore system including a borehole in a subsurface formation, a string in the borehole, and a disk as in any prior embodiment, disposed within or as a part of the string.

Embodiment 15: The system as in any prior embodiment, wherein the inside surface includes a stress riser.

Embodiment 16: The system as in any prior embodiment, wherein the stress riser extends through the inside surface and leaves unbroken an outside surface of the body.

Embodiment 17: The system as in any prior embodiment, wherein the stress riser is a pattern of stress risers.

Embodiment 18: The system as in any prior embodiment, wherein the pattern is a dot matrix.

Embodiment 19: The system as in any prior embodiment, wherein the pattern includes grooves connecting nodes.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A rupture disk comprising:

a single-piece body having a pair of domes oriented in opposing directions, the domes defining a closed geometric hollow shape and having an inside surface defining a hollow therein;

a fluid port disposed in the single-piece body to make connection between the hollow and a fluid pressure source;

a plurality of stress risers configured as grooves and nodes located on the inside surface of the single piece body, the nodes being located intersections of the grooves and more deeply enter the body than do the grooves, the stress risers extending through the inside surface and leaving unbroken an outside surface of the body.

2. The disk as claimed in claim 1 wherein the body comprises a rigid material.

3. The disk as claimed in claim 1 wherein the body is a ceramic material.

4. The disk as claimed in claim 1 wherein the inside surface further includes a plurality of unconnected indentations.

5. The disk as claimed in claim 4 wherein the stress riser is a pattern of stress risers.

6. The disk as claimed in claim 4 wherein the unconnected indentations is a dot matrix.

7. A method for operating a wellbore comprising:

applying pressure though the port of a disk as claimed in claim 1; and rupturing the disk with the applied pressure.

8. The method as claimed in claim 7 wherein the applying is from a surface source of pressure.

9. The method as claimed in claim 7 wherein the applying is from a downhole source of pressure.

10. The method as claimed in claim 7 wherein the rupturing includes initiating fractures at stress risers in the body.

11. The method as claimed in claim 10 wherein the stress risers are in fluid communication with the hollow.

12. A wellbore system comprising:

a borehole in a subsurface formation;

a string in the borehole; and a disk as claimed in claim 1 disposed within or as a part of the string.

13. The system as claimed in claim 12 wherein the inside surface includes a plurality of unconnected indentations.

14. The system as claimed in claim 13, wherein the plurality of unconnected indentations is in a dot matrix.

* * * * *